US006378274B1

(12) United States Patent
Harbour

(10) Patent No.: US 6,378,274 B1
(45) Date of Patent: Apr. 30, 2002

(54) PROCESS FOR PRODUCING A WATER SOLUBLE PACKAGE

(75) Inventor: Richard Harbour, Port Sunlight (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/525,082

(22) Filed: Mar. 14, 2000

(30) Foreign Application Priority Data

Mar. 17, 1999 (GB) ..... 9906176

(51) Int. Cl.[7] ..... B65B 47/00

(52) U.S. Cl. ..... 53/453; 53/427; 53/455; 53/456; 53/464; 53/559

(58) Field of Search ..... 53/464, 453, 455, 53/456, 427, 559, 440

(56) References Cited

U.S. PATENT DOCUMENTS

| | | | | |
|---|---|---|---|---|
| 2,377,188 A | | 5/1945 | Weisman | 99/77.1 |
| 3,545,163 A | * | 12/1970 | Mahaffy et al. | 53/22 |
| 3,892,905 A | | 7/1975 | Albert | 428/220 |
| 3,958,394 A | | 5/1976 | Mahaffy et al. | 53/112 |
| 4,416,791 A | | 11/1983 | Haq | 252/90 |
| 4,562,717 A | | 1/1986 | Shimizu et al. | 72/347 |
| 4,610,799 A | | 9/1986 | Wilsberg et al. | 252/90 |

(List continued on next page.)

FOREIGN PATENT DOCUMENTS

| | | |
|---|---|---|
| BE | 9700361 | * 12/1986 |
| DE | 93 03 456 | 6/1993 |
| DE | 19521 140 | * 12/1996 |

(List continued on next page.)

OTHER PUBLICATIONS

Derwent Abstract of JP9087105, Mar. 31, 1997.*
Derwent Abstract of FR 2684594, Jun. 11, 1993.*
Derwent Abstract of FR 2675734, Oct. 30, 1992.*
GB Search Report in Patent Application # 9906169.9.*
GB Search Report in Patent Application # 9906175.6.*
GB Search Report in Patent Application # 9906176.4.*
GB Search Report in Patent Application # 9906179.8.*
GB Search Report in Patent Application # 9906171.5.*
Derwent Abstract of EP 0 343 069, Nov. 23, 1989.*
Derwent Abstract of EP 0 373 395, Jun. 20, 1990.*
Derwent Abstract of FR 2 601 930, Jan. 29, 1988.*
PCT International Search Report in an International Patent Application PCT/EP 00/01646.
PCT International Search Report in a PCT application PCT/EP 00/01944.
PCT International Search Report in a PCT application PCT/EP 00/01648.
PCT International Search Report in a PCT application PCT/EP 00/01647
PCT International Search Report in a PCT application PCT/EP 00/01943.
PCT International Search Report in a PCT application PCT/EP 00/01942.
Derwent Abstract of DE 12 87 502.

*Primary Examiner*—Rinaldi I. Rada
*Assistant Examiner*—Christopher Harmon
(74) *Attorney, Agent, or Firm*—Rimma Mitelman

(57) ABSTRACT

A process for producing a thermoformed package comprises the steps of placing a first sheet of film over a forming die having at least one cavity, heating the film to mold the film into the at least one cavity thereby forming at least one recess in the film, placing a composition in the at least one formed recess; and sealing a second sheet of film across the at least one formed recess to produce at least one closed package. The film is heated by a heating plate having at least one concave depression which in use overlies the at least one cavity, wherein the heating step involves the step of bringing the film into intimate contact with the or each depression.

10 Claims, 1 Drawing Sheet

U.S. PATENT DOCUMENTS

Figure 1:
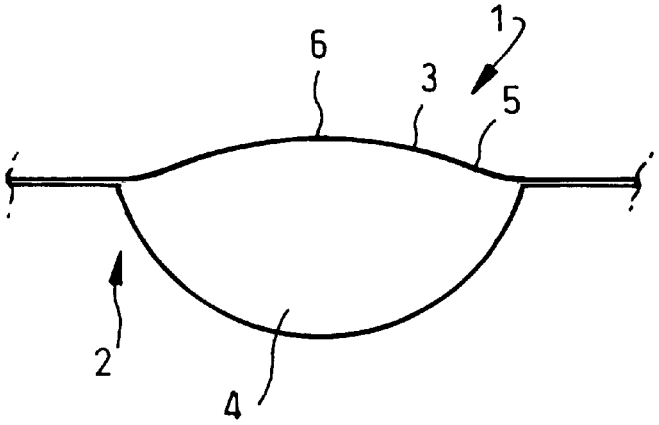

| | | | | | |
|---|---|---|---|---|---|
| 4,649,046 | A | * | 3/1987 | Kross | 424/76 |
| 4,846,992 | A | | 7/1989 | Fonsmy | 252/90 |
| 4,969,927 | A | | 11/1990 | Schumann et al. | 8/159 |
| 4,971,748 | A | | 11/1990 | Sado et al. | 264/553 |
| 4,973,416 | A | | 11/1990 | Kennedy | 252/90 |
| 5,180,765 | A | * | 1/1993 | Sinclair | 524/306 |
| 5,224,601 | A | | 7/1993 | Gouge et al. | 428/220 |
| 5,227,177 | A | | 7/1993 | Reil et al. | 425/388 |
| 5,394,603 | A | | 3/1995 | Reil et al. | 29/463 |
| 5,418,022 | A | * | 5/1995 | Anderson et al. | 428/35.2 |
| 5,529,224 | A | * | 6/1996 | Chan et al. | 222/107 |
| 5,665,824 | A | | 9/1997 | Chang et al. | 525/185 |

FOREIGN PATENT DOCUMENTS

| | | | |
|---|---|---|---|
| DE | 298 01 621 | * | of 1998 |
| EP | 0 079 712 | * | 5/1983 |
| EP | 0 157 612 | * | 10/1985 |
| EP | 160 254 | * | 11/1985 |
| EP | 0 266 583 | | 5/1988 |
| EP | 0 272 796 | | 6/1988 |
| EP | 158 464 B1 | * | 7/1989 |
| EP | 0 343 069 | | 11/1989 |
| EP | 0 343 070 | | 11/1989 |
| EP | 0 347 221 | | 12/1989 |
| EP | 0 366 231 | | 5/1990 |
| EP | 0 373 395 | | 6/1990 |
| EP | 0 518 689 B1 | | 12/1992 |
| EP | 0 291 198 | * | 11/1993 |
| EP | 0 608 910 | | 3/1994 |
| EP | 0 593 952 | | 4/1994 |
| EP | 0 389 513 | | 7/1994 |
| EP | 0 700 989 | | 3/1996 |
| EP | 0 718 199 | * | 6/1996 |
| EP | 0 746 514 | * | 12/1996 |
| EP | 0 748 673 | * | 12/1996 |
| EP | 0 941 939 | | 9/1999 |
| FR | 2 601 930 | * | 1/1988 |
| FR | 2 724 388 | * | 3/1996 |
| GB | 631484 | | 11/1949 |
| GB | 989 350 | | 4/1965 |
| GB | 1 381 376 | | 1/1975 |
| GB | 2 060 544 | | 5/1981 |
| GB | 2 090 603 | * | 7/1982 |
| GB | 2 118 961 | | 11/1983 |
| GB | 2 211 196 | | 6/1989 |
| GB | 2 221 158 | | 1/1990 |
| GB | 2 257 388 | | 1/1993 |
| GB | 2 259 883 | | 3/1993 |
| GB | 2 305 931 | | 4/1997 |
| WO | 89/04282 | | 5/1989 |
| WO | 92/17382 | | 10/1992 |
| WO | 96/00251 | * | 1/1996 |
| WO | 96/29189 | | 9/1996 |
| WO | 97/00282 | * | 1/1997 |
| WO | 97/27743 | | 8/1997 |

* cited by examiner

PROCESS FOR PRODUCING A WATER SOLUBLE PACKAGE

The invention relates to a process for producing a thermoformed package of the type comprising the steps of placing a first sheet of formable film over a forming die having a cavity, moulding the film into the cavity thereby forming a recess in the film, placing a composition in the thus formed recess, and sealing a second sheet of film across the recess to close the package. In particular, the invention relates to such a process for producing a water-soluble package containing a detergent composition.

Detergent compositions for the machine washing of laundry are provided in many forms. Probably the most prevalent form of laundry detergent is washing powder or granules. A problem with the use of these forms of detergent is that the product needs to be dosed into the machine in such a way that the detergent is quickly and thoroughly dissolved in the wash water of the machine without coming into contact with the laundry in a solid form. In this regard many dosing devices which overcome this problem have been proposed. One such device disclosed in European Patent Nos. 0 343 070 and 0 343 069 teaches the use of a flexible fabric sock which holds the particulate detergent in the machine, the fabric of the sock being permeable to water so as to allow water enter the sock and carry the detergent out of the sock through the fabric walls in the form of an aqueous solution. More recently unit dose forms of detergent have been proposed in the form of compressed tablets of detergent powder. A problem encountered with the provision of detergent tablets is that the tablets need to be strong enough to withstand storage and transport, yet weak enough to disintegrate and dissolve quickly in the washing machine.

A further problem is the need to prevent the tablets "posting" in the porthole and between the drums of conventional washing machines. More recently these problems have been overcome by the provision of detergent tablets having specific chemical disintegrants which allow quick disintegration of the tablets in the aqueous environment of a washing machine, and by the provision of loosely fitting net bags which aid tablet disintegration and prevent "posting". However, as many of the current detergent tablets contain bleach and other irritant substances, the problem of handling the tablets remains.

The provision of detergent compositions in water-soluble films has been known for some time. Most of the documents relating to this subject describe water soluble film envelopes formed using a vertical form-fill-seal (VFFS) route. A problem with envelopes produced using this VFFS method is that, due to the constraints of the process, the resultant envelopes have seals which incorporate defined weak points where the seals overlap at corners. This results in envelopes, which are easily corrupted as a result of impacts suffered during transport. In an attempt to overcome the problems associated with such VFFS envelopes, European Patent Application No. 0 608 910 describes thermoformed water soluble packages for pesticidal compositions of the above mentioned type, which packages include a seal which does not have any angular intersections with itself. While this specification does provide a partial solution to the problem of weak seals, the thermoforming of water-soluble films results in formed packages having many other weak points. Moreover, the packaging and transport of such packages subjects the formed packages to considerable impact forces.

It is an object of the invention to overcome at least some of the above problems.

STATEMENTS OF INVENTION

According to the invention, there is provided a process for producing a thermoformed package of the above mentioned type, the process being characterised in that the film is heated by a heating plate having at least one concave depression which in use overlies the at least one cavity, wherein the heating step involves the step of bringing the film into intimate contact with the or each depression. The use of a heating plate having one or more concave depressions improves uniformity of the thermoformed film which results in a package having more uniform thickness and therefore fewer weak spots.

In one embodiment of the invention, intimate contact between the film and the concave depression is achieved by exerting a vacuum between the depression and the film. In this regard the depression may include a hole or holes through which the vacuum may be pulled. Alternatively, the heating plate may comprise a porous material. When a vacuum is exerted in this manner, the vacuum should ideally comprise a pressure of up to 1 Bar, and preferably be less that 0.6 Bar, for example about 0.3 Bar. In an alternative embodiment of the invention, the film is forced into intimate contact with the concave depression by blowing air against it. Typically the pressure of the blown air will be less than 5 Bar, preferably less than 3 Bar. The heating plate preferably has a temperature in the region of 100 to 135 degrees C., and ideally is approximately 120 to 130 degrees C. Although the time the film contacts the heating plate depends to a large extent on the type of film used and the temperature of the heating plate, the time of contact between the film and the plate should be in the region 0.1 to 5 seconds, preferably 0.5 to 1 seconds, ideally approximately 700 milliseconds.

In a particularly preferred embodiment of the invention, the at least one concave depression is circular. In such a case it is preferable that the ratio of the diameter of the depression to the ratio of the depth of the depression is between 4:1 and 50:1, typically between 5:1 and 40:1, suitably between 7:1 and 30:1, ideally between 8:1 and 20:1. In a most preferable embodiment, the ratio is approximately 10:1. Thus in an embodiment of the invention which will be described in further detail below, the concave depression is circular having a diameter of approximately 50 mm and a depth of about 5 mm.

Ideally, the concave depression has a radiussed edge. Preferably the depression has a base having a radius of curvature, wherein the ratio of the radius of curvature of the base to the radius of curvature of the edge is preferably between 5:1 to 1:1, and most preferably is about 2:1. Typically, a single plate may have a plurality of concave depressions which in most instances will correspond to an equal number of cavities in the forming die.

In one embodiment of the invention the film is a water-soluble film. Ideally the package contains a liquid, gel or other type of fluent composition. Preferably, the liquid comprises a detergent or any other type of active agent used in the machine washing of laundry or dishes. In another embodiment of the invention, the package contains bathing or shower gel composition or any other type of personal care composition.

The invention also relates to a heating plate for thermoforming film, which plate comprises at least one concave depression. The concave depressions may include any of the features described above including the features relating to the radii of curvature of the base and edge of the depression.

DETAILED DESCRIPTION OF THE INVENTION

Figure 2:
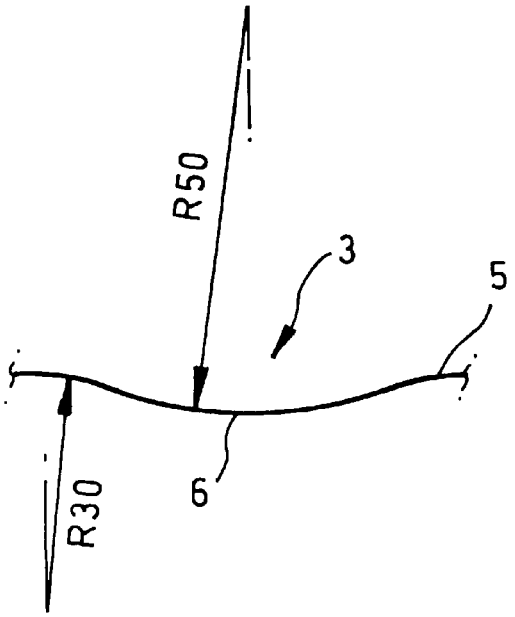

The invention will be more clearly understood from the following description of an embodiment thereof, given by way of example only, with reference to the accompanying drawings in which:

FIG. 1 is a sectional view illustration portions of a forming die and heating plate according to the process of the invention; and FIG. 2 is a detailed sectional view of a concave depression used according to the invention.

EXAMPLE

In this example a thermoforming process is described where a number of packages according to the invention are produced from a sheet of water soluble material, namely polyvinyl alcohol supplied under reference CC8534 by Chris Craft. In this regard recesses are formed in the sheet using a forming die having a plurality of cavities with dimensions corresponding generally to the dimensions of the packages to be produced. Further, a single heating plate is used for preheating the film before moulding the film into all the cavities. In the same way a single sealing plate is described.

A first sheet of polyvinyl alcohol film is drawn over a forming die so that the film is placed over the plurality of forming cavities in the die. Each cavity is generally dome shape having a round edge, the edges of the cavities further being radiussed to remove any sharp edges which might damage the film during the forming or sealing steps of the process. Each cavity further includes a raised surrounding flange. In order to maximise package strength, the film is delivered to the forming die in a crease free form and with minimum tension.

In the forming step, and referring to FIGS. 1 and 2, the film is heated to 125 degrees C., for approximately 600 microseconds. A heating plate 1 is used to heat the film, which plate is positioned to superpose the forming die 2. The plate includes a plurality of concave depressions 3 (only one is shown) which correspond to the recesses 4 on the forming die 2. Each concave depression is generally circular having a diameter of approximately 50 mm and a depth of about 5 mm. An edge 5 of the depression 3 is radiussed as is the base 6, the radius of the base being about 50 mm and the radius of the edge being about 30 mm. During this preheating step, a vacuum is pulled through the pre-heating plate to ensure intimate contact between the film and the pre-heating plate 1, this intimate contact ensuring that the film is heated evenly and uniformly (the extent of the vacuum is dependant on the thermoforming conditions and the type of film used, however in the present context a vacuum of less than 0.6 bar was found to be suitable) Non-uniform heating results in a formed package having weak spots. As an alternative, or in addition, to the vacuum, it is possible to blow air against the film to force it into intimate contact with the preheating plate. In such cases the air should be blown at a pressure of less than 3 Bar.

After the preheating step, the thermoforming film is moulded into the cavities in the die by the application of a vacuum through the walls of the cavities and by blowing air through the depression. This vacuum is maintained at least until the packages are sealed. Once the recesses are formed and held in position by the vacuum, the composition, in this case a liquid detergent is added to each of the recesses. A second sheet of polyvinyl alcohol film is then superposed on the first sheet covering the filled recesses and heat-sealed thereto using a heating plate. The heat sealing plate has a number of annular protrusions corresponding to the raised flanges on the forming die. However, the heat sealing plate could also be flat.

The heat sealing plate operates at a temperature of about 140 to 180 degrees centigrade, and contacts the films for 1 to 2 seconds and with a force of 8 to 30 kg/cm2, preferably 10 to 20 kg/cm2. The raised flanges surrounding each cavity ensure that the films are sealed together along the flange to form a continuous seal. The radiussed edge of each cavity is at least partly formed a by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

During the forming, filling and sealing steps of the process, the relative humidity of the atmosphere is controlled to ca. 50%. This is done to maintain the heat sealing characteristics of the film. When handling thinner films it may be necessary to reduce the relative humidity to ensure that the films have a relatively low degree of plasticisation and as such tend to be stiffer resulting in easier handling. The actual specific RH of the atmosphere needed will vary according to the temperature of the environment and the type of film used, however for temperatures in the region of 20 degrees C., the RH should be in the region of 30 to 50% depending on the thickness and elasticity of the film.

The invention is not limited to the embodiments hereinbefore described which may be varied in both construction, detail and process step without departing from the spirit of the invention.

What is claimed is:

1. A process for producing a thermoformed package comprising the steps of:

placing a first sheet of film over a forming die having at least one cavity;

heating the film;

moulding the film to mould the film into the at least one cavity thereby forming at least one recess in the film;

placing a composition in the at least one formed recess; and sealing a second sheet of film across the at least one formed recess to produce at least one closed package, wherein the process comprises heating the film by a heating plate having at least one concave depression which in use overlies the at least one cavity, wherein the heating step involves the step of bringing the film into intimate contact with the depression.

2. A process as claimed in claim 1 in which the concave depression is generally circular.

3. A process as claimed in claim 1 in which a ratio of a diameter of the depression to a depth of the depression is between 4:1 and 50:1.

4. A process as claimed in claim 3 in which the ratio is approximately 10:1.

5. A process as claimed in claim 4 in which an edge of the depression is curved, chamfered or bevelled.

6. A process as claimed in claim 5 in which the curved edge has a radius of curvature.

7. A process as claimed in claim 6 in which a base of the depression has a radius of curvature, wherein a ratio of the radius of curvature of the base to the radius of curvature of the edge is between 5:1 and 1:1.

8. A process as claimed in claim 7 in which the ratio is about 2:1.

9. A process according to claim 1, wherein the film is brought into intimate contact with the depression by sucking or by blowing the film.

10. A package formed by a process as claimed in claim 1.

* * * * *